US006273289B1

(12) United States Patent
Bowman

(10) Patent No.: US 6,273,289 B1
(45) Date of Patent: Aug. 14, 2001

(54) PAINTER'S TRAY FOR LADDER

(76) Inventor: Monte L. Bowman, 188 Township Rd. 1402, Polk, OH (US) 44866

( * ) Notice: Subject to any disclaimer, the term of this patent is extended or adjusted under 35 U.S.C. 154(b) by 0 days.

(21) Appl. No.: 09/597,308

(22) Filed: Jun. 20, 2000

(51) Int. Cl.[7] ..... B65D 25/00
(52) U.S. Cl. ..... 220/570; 220/482; 220/751
(58) Field of Search ..... 220/570, 482, 220/751, 914

(56) References Cited

U.S. PATENT DOCUMENTS

| | | | | |
|---|---|---|---|---|
| 412,499 | * | 10/1889 | Hamilton | 220/482 |
| 3,325,038 | * | 6/1967 | Ferney | 220/482 |
| 3,707,242 | * | 12/1972 | Golden et al. | 220/570 |
| 3,837,034 | * | 9/1974 | Leffert et al. | 220/570 |
| 5,052,581 | * | 10/1991 | Christ et al. | 220/570 |
| 5,064,090 | * | 11/1991 | Farrigr | 220/482 |
| 5,236,161 | * | 8/1993 | Haven | 220/570 |
| 5,461,752 | * | 10/1995 | Lemon et al. | 220/759 |
| 5,533,228 | * | 7/1996 | Tereki et al. | 220/570 |
| 5,865,409 | * | 2/1999 | Nimer | 220/570 |
| 5,899,420 | * | 5/1999 | Gerandi | 220/48 |
| 5,924,615 | * | 7/1999 | McGarrah | 220/482 |

* cited by examiner

*Primary Examiner*—Joseph M. Moy
(74) *Attorney, Agent, or Firm*—Jerry Semer

(57) ABSTRACT

The invention is a portable container capable of holding paint cans, paint supplies, brushes, and paint-related tools. The container is shaped like a trapezoidal prism with the front and back being parallel and the top and bottom also being parallel to each other. The container on the top has a number of wells that allows for placement of cans of paint and other paint-related material, including brushes. There are also openings in the side where paint-related materials can also be placed as well as paint scrapers, hammers, hooks, and rags. On the back of the container are four hook-like devices that are designed to fit over the rungs of a ladder. When the painter uses the container he first places the ladder up against the building. He then fills the invention with the paint can and brushes he wishes to use. He picks up the invention, carries it up the ladder to the rung in which he wishes for the invention to be on and places it over that rung. As he paints, his body weight is up against the container and thus holds the container securely in place on the ladder.

12 Claims, 2 Drawing Sheets

PAINTER'S TRAY FOR LADDER

FIELD OF INVENTION

This invention relates to a ladder-mounted tray for painters and, more particularly, to a detachable-ladder mounted tray that holds paint cans, paint supplies and paint-related tools such as brushes.

BACKGROUND OF THE INVENTION

In the field of painting and decorating, despite the technology advances that have been made in the rapid application of paints and stains to large areas by the employment of airless sprays and pressurized roll technologies, it is still necessary for a craftsman to apply paint to window sashes, frames, doors, trims and difficult-to-reach areas by traditional brush and roller means while standing on a ladder. In order to accomplish many coverage areas, the painter has to be in awkward, uncomfortable and often dangerous positions on his ladder. Unlike the carpenter or plumber who proceeds the painter, the painter is not afforded the luxury of a dry, readily"pocketable" or "enpouchable" tools. The very nature of painters' craft dictates that his tools will be covered with paint in order to accomplish his job at hand. Also, unlike the carpenter, whose nails and screws may be readily carried in a pouch or nail apron with little likelihood of spillage and little damage done should the spill occur, the painter must carry his materials in a liquid-containing pail or bucket which must have an opening at the top thereof to permit frequent required reloading of the paint brush while constantly attempting to maintain the paint pail or bucket in a near vertical position to prevent serious spillage of the compound which, at best, is difficult and costly to remove and at worst, may require employment of sophisticated solvent compounds which may have adverse affects upon the environment. Furthermore, unlike nails which may fall on the ground and be easily reused, paint, once spilled is forever lost, thus placing an economic burden of material replacement upon the painter.

Another challenge faced by trim or finish painters is carrying all the tools that will be used or needed to accomplish a complete painting operation without the requirement for constant descending and re-ascending a ladder to sequentially acquire different tools required to finish the job or task at hand. Of course climbing and descending from a ladder causes another hazard. Historically, as reflected by the prior art, attempts have been made to make it easier for painters and others to carry materials and equipment attached to, or suspended from, the body of the users through the employment of various belts, harnesses, and attachments and some progress has been made, though no commercial success or general usage of earlier teaching is in evidence. Examples of these devices are found in U.S. Pat. No. 5,489,051 to Robinson, U.S. Pat. No. 5,385,281 to Bird. The main problem with these devices is that they hang on the side of the painter and add additional weight to the painter and may cause him to become unbalanced when he ascends or descends or is painting on the ladder. Thus one of the objectives of this invention to eliminate the need for the painter to hold or suspend the paint from his person so that the painter can move around on his ladder without fear of losing his balance or spilling the paint. One of the features that solves this problem is that the invention is not carried on the person of the painter. The invention is supported by the ladder.

This feature has also occurred in the prior art in U.S. Pat. No. 5,052,581 to Christ et. al. U.S. Pat. No. 4,991,808 LaChance, U.S. Pat. No. 5,636,817 to Beachy, and U.S. Pat. No. 4,527,763 to Woytowich. U.S. Pat. No. 4,911,808 to LaChance shows a bracket attached to the side of a ladder. The problem with this set up is similar to the problem with a belt around the painter's waist with the paint can attached and hanging down from the side of the painter. This setup places additional weight on side of the ladder and thus makes the ladder unsteady. U.S. Pat. No. 5,636,817 to Beachy shows a device attached by nuts and bolts to the top of a ladder. The problem with this device is that it needs to be attached to the ladder and becomes nearly a permanent attachment through the bolts. Secondly one would need to attach the device to the ladder and place the ladder in position against the building before the paint cans and paint brushes can be placed in the holder. Thus, the painter may have to make more than one trip of the ladder to place the cans and brushes in place. Also, from the patent it looks as if the paint tray fits on the top or next to the top rung of the ladder. Thus, the painter has to be painting near the top of the ladder in order to use this devise. Thus, one of the objectives of the invention is to create a paint tray that can be used by the painter at more than one position on the ladder. U.S. Pat. No. 5,052,581 to Christ et. al. and U.S. Pat. No. 4,527,763 to Woytowoich also have much the same problem as Beeche. They need to be attached, since their attachment is complicated, to the ladder before it is placed in position. Thus, the paint trays must be attached to the ladder and the ladder placed in position and then the paints must be moved us to the ladder. Thus, one of the objectives of this invention is to create a paint tray for a ladder that can be easily carried up the ladder and attached in position once the ladder is already placed in position. This makes the placing of the paint tray on the ladder more efficient and does not require the painter to move up and down the ladder a few times just to place his articles in the paint tray. Another objective of the invention that cannot be accomplished by Beeche, Christ, or Woytowoich are that the paint tray can be moved while the painter is doing his painting on the ladder without taking the ladder down and removing the paint tray and placing it at another position and placing it back up again. The painter can actually remove the paint tray while he is doing his work. Thus, if he needs to move a little bit higher on the ladder he could take the paint tray off one rung and move it up a couple rungs higher without taking the ladder down to remove the tray. This allows the painter to work more efficiently and be able to move around in many different positions.

SUMMARY OF THE INVENTION

The invention is a portable container capable of holding paint cans, paint supplies, brushes, and paint-related tools. The container is shaped like a trapezoidal prism with the front and back being parallel and the top and bottom also being parallel to each other. The container on the top has a number of wells that allows for placement of cans of paint and other paint-related material, including brushes. There are also openings in the side where paint-related materials can also be placed as well as paint scrapers, hammers, hooks, and rags. On the back of the container are four hook-like devices that are designed to fit over the rungs of a ladder. When the painter uses the container he first places the ladder up against the building. He then fills the invention with the paint can and brushes he wishes to use. He picks up the invention, carries it up the ladder to the rung in which he wishes for the invention to be on and places it over that rung. As he paints, his body weight is up against the container and thus holds the container securely in place on the ladder.

DETAILED DESCRIPTION OF THE PREFERRED EMBODIMENT

Figure 1:
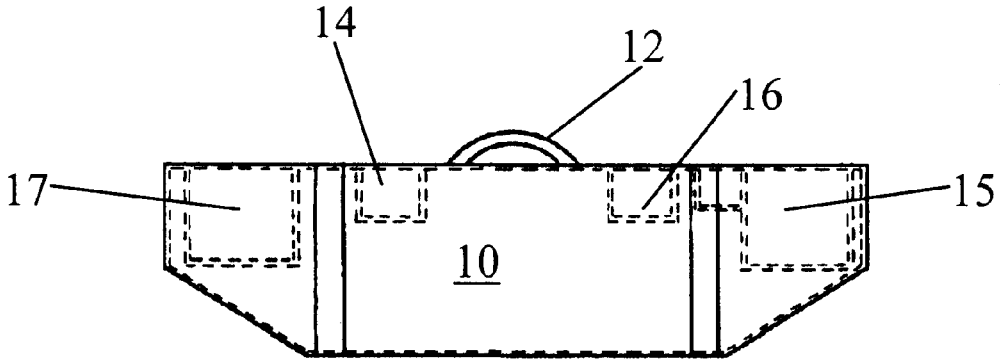
FIG. 1 is a front view of the invention
Figure 2:
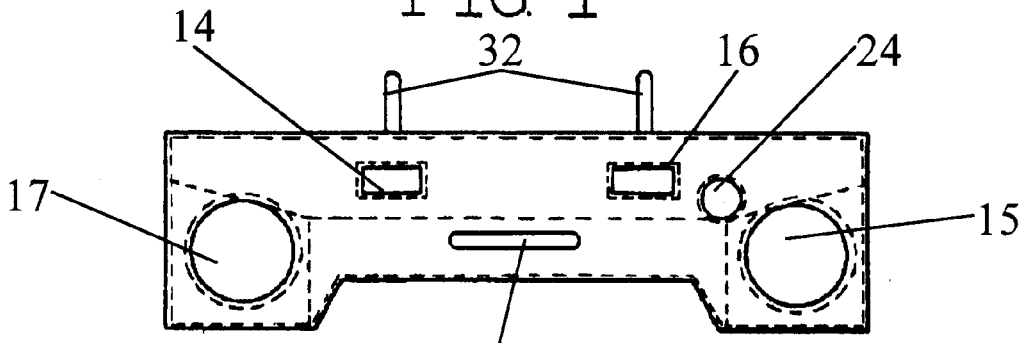
FIG. 2 is a top view of the invention.

FIG. 1 shows the front view of the invention. From FIG. 1, one can see that the invention is a container 10 with a handle 12. FIG. 2 is top view of the invention. From FIG. 2 you can see that there are numerous cavities in the invention. FIG. 2, the top view of the invention, also shows the placement of these cavities. FIG. 2 shows the circular opening 15 and 17 on the two ends of the container that are large enough to hold a one-gallon paint can in the preferred embodiment. Towards the center of the invention, is two rectangular cavities 14 and 16 that are designed to hold brushes. The invention in the preferred embodiment is designed with two brush holder. However, there is room to place more than two brush holders within the container. Right in the middle of the top of the invention is the handle 12. Also on top of the invention is a circular opening 24 which are a drinking cup holder or a holder for a pop can. FIG. 2 also shows that the front surface of the invention is concaved. This indention is designed such that when the holder is placed on the ladder, the painter can lean up against the invention and have the paint cans near his side.

Figure 3:
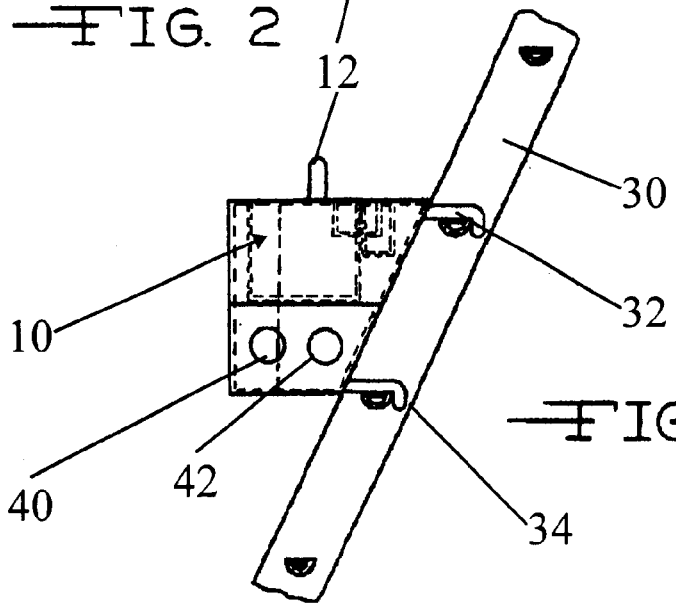
FIG. 3 is a side view of the invention.

FIG. 3 shows an end view of the invention when it is placed upon a ladder. FIG. 3 shows the container 10, ladder 30, and hook 32 and 34. If we look at both FIG. 2 and FIG. 3, we will see that FIG. 3 shows two hooks 32 and 34 on the rear of the container 10. FIG. 2 shows only hooks 32 on the rear of the container 10. Actually, behind hooks 32 are hooks 34. These hooks 32 and 34 are adapted to fit over the rungs of the ladder 30 and hold the container 10 securely in place. The pair of top hooks 32 and bottom hooks 34 are spaced apart slightly less than the average width of a rung of ladder 30 so that they will securely hold the container on the ladder 30. The container 10 is even more securely held to the ladder by the fact that the painter will put pressure on the front of the container 10 while he is painting thus pressing the container 10 against the ladder. One can also see from the end view in FIG. 3 of the container 10 that the container's back side is angled compared to the front. This angle is approximately the same angle as the ladder 30 would be against a building. Thus, the container 10 will fit securely against the ladder 30 and keep the container's 10 top parallel to the ground. Also, in the end of the container are several circular openings. These openings 40 and 42 are designed to keep items such as scrapers, hooks, rags, hammers and screw drivers that can be used by the painter while he is up the ladder 30.

Figure 4:
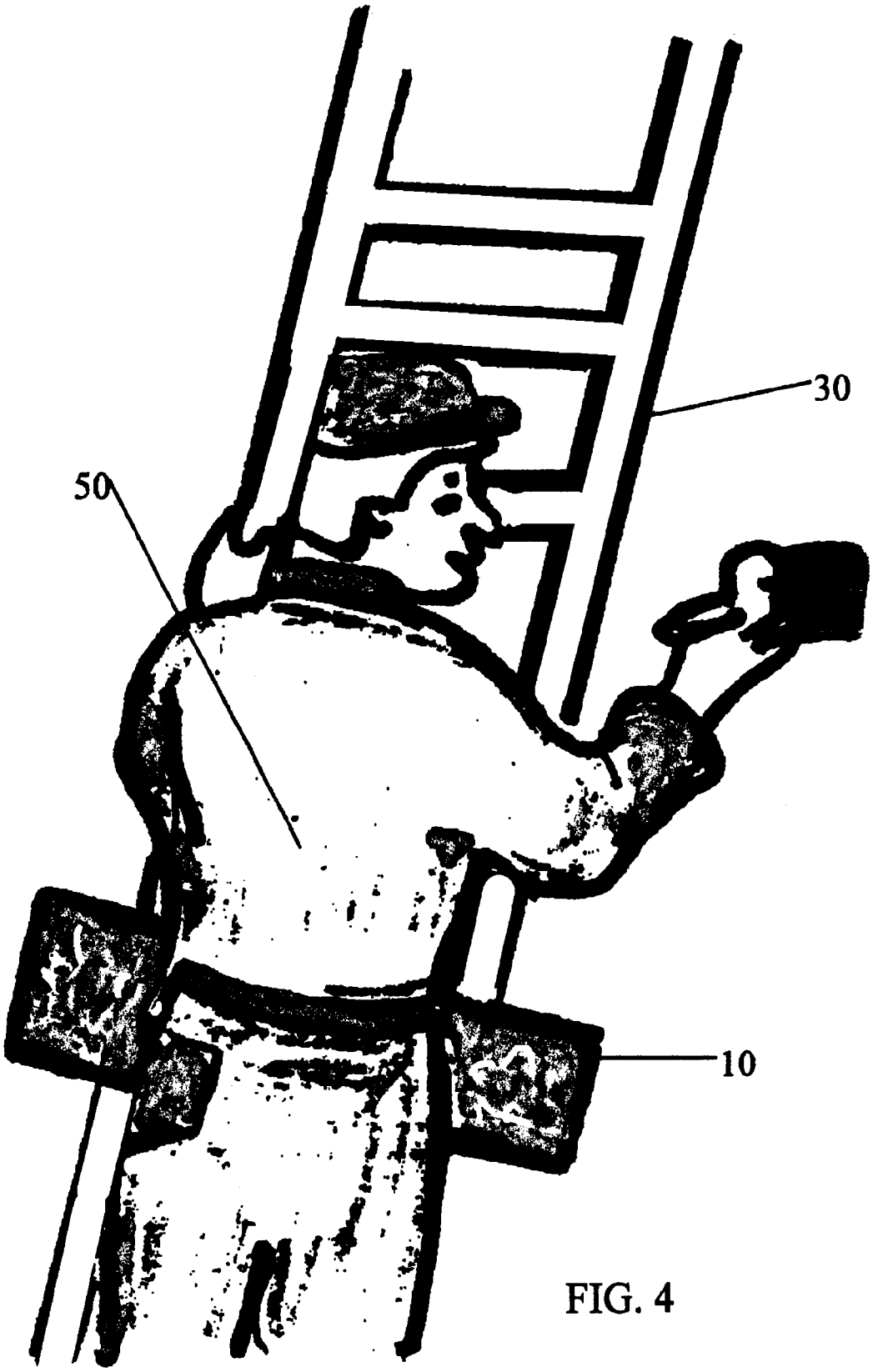
FIG. 4 is a view of the invention in use.

FIG. 4 shows the invention in use with the painter 50 painting the house 52 and his body resting up against the container 10 which rests up against the ladder 30. To use the container 10, the painter 50 first places the ladder 30 against the house or building. Then, he fills the container 10 with the items he needs such as paint can, paint brushes, rags, hammer, or other items and maybe even a cup of coffee or a Coke. He then picks up the container 10 by the handle 12 and carries it up the ladder 30. He places the top and bottom hooks 32 and 34 over the rungs to securely place the container 10 in place. As stated above, the back side of the container 10 is angled so it will fit up securely against the ladder 30 and keep the top of the container 10 parallel to the ground. He then leans up against the container 10 and begins to paint. When he is through, he just unhooks the container 10 and carries it down the ladder 30 by the handle 12. The container 10 is also designed so that it can actually be moved while the painter is painting. Thus, say he starts on a rung near the top of the ladder. As he paints downward, he decides that he needs to move his paint container down a few rungs, he just picks up the paint container 10 by the handle 12, moves it down a couple rungs and places the hooks 32 and 34 over the rungs. Thus, the paint container 10 is now in a new position on the ladder a couple on rungs lower.

Changes and modifications in the specifically described embodiments can be carried out without departing from the scope of the invention which is intended to be limited only by the scope of the appending claims.

What is claimed is:

1. A paint tray which hold paint for a painter painting on a ladder adapted to hook to a ladder when the ladder is against a wall comprising:

a. a housing that is adapted to hold paint and said housing has a top, front, backed, and sides and said front has two ends, and at each end of the front are cavities adapted to hold paint, and said housing top has another cavity and is adapted to hold a paint brush; and, b. the back of the housing is angled downward from the top and said angle is approximately the same angle as the ladder leans against said wall; and, c. a handle attach to the top of the housing; and, d. hooks attached to the back of the housing adapted to fit over a set of rungs of the ladder and hold the housing in place when the housing is loaded with paint and the housing when hooked with the hooks over the ladder make contact on both ends with the rails of the ladder and said hooks are adapted such that the painter can move the paint tray to a different set of rungs easily while the painter is on the ladder.

2. A paint tray adapted to hook to a ladder when it is against a wall as in claim 1 further comprising:

a. opening in the side of the container adapted to hold rags.

3. A paint tray adapted to hook to a ladder when it is against a wall as in claim 1 further comprising:

a. an opening in the top adapted to hold a pop can or water bottle.

4. A paint tray adapted to hook to a ladder when it is against a wall as in claim 1 wherein:

a. the front of the housing is concave.

5. A paint tray adapted to hook to a ladder when it is against a wall as in claim 1 wherein:

a. the cavities for holding paint hold paint cans.

6. A paint tray adapted to hook to a ladder when it is against a wall as in claim 5 wherein:

a. the cavities for holding paint hold gallon paint cans.

7. A paint tray adapted to hook to a ladder when it is against a wall as in claim 6 further comprising:

a. another cavity for a paint brush.

8. A paint tray adapted to hook to a ladder when it is against a wall as in claim 7 wherein:

a. the front of the housing is concave.

9. A paint tray adapted to hook to a ladder when it is against a wall as in claim 8 further comprising:

a. opening in the side of the container adapted to hold rags.

10. A paint tray adapted to hook to a ladder when it is against a wall as in claim 9 further comprising:

a. an opening in the top adapted to hold a pop can or water bottle.

11. A paint tray adapted to hook to a ladder when it is against a wall as in claim 1 further comprising:

a. a second opening in the side of the container adapted to hold a paint scraper.

12. A paint tray adapted to hook to a ladder when it is against a wall as in claim 2 further comprising:

a. a second opening in the side of the container adapted to hold a paint scraper.

* * * * *